US007198549B2

(12) United States Patent
Steckenrider et al.

(10) Patent No.: US 7,198,549 B2
(45) Date of Patent: Apr. 3, 2007

(54) CONTINUOUS CONTOUR POLISHING OF A MULTI-MATERIAL SURFACE

(75) Inventors: J. Scott Steckenrider, Plainfield, IL (US); Gary W. Snider, Oswego, IL (US)

(73) Assignee: Cabot Microelectronics Corporation, Aurora, IL (US)

( * ) Notice: Subject to any disclaimer, the term of this patent is extended or adjusted under 35 U.S.C. 154(b) by 198 days.

(21) Appl. No.: 10/869,605

(22) Filed: Jun. 16, 2004

(65) Prior Publication Data

US 2005/0282470 A1 Dec. 22, 2005

(51) Int. Cl.
*B24B 1/00* (2006.01)

(52) U.S. Cl. ..... 451/36

(58) Field of Classification Search ..... 451/36, 451/41, 526, 530, 57–59
See application file for complete search history.

(56) References Cited

U.S. PATENT DOCUMENTS

| | | | |
|---|---|---|---|
| 4,167,304 | A | 9/1979 | Gelbke |
| 4,184,859 | A | 1/1980 | Maklad |
| 4,330,171 | A | 5/1982 | Malsot et al. |
| 4,474,429 | A | 10/1984 | Yoldas et al. |
| 4,493,720 | A | 1/1985 | Gauthier et al. |
| 4,510,005 | A | 4/1985 | Nijman |
| 4,603,940 | A | 8/1986 | Shaw et al. |
| 4,738,055 | A | 4/1988 | Jackson et al. |
| 4,762,416 | A | 8/1988 | Lefevre et al. |
| 4,818,263 | A | 4/1989 | Mitch |
| 4,831,784 | A | 5/1989 | Takahashi |
| 4,839,993 | A | 6/1989 | Masuko et al. |
| 4,905,415 | A | 3/1990 | Moulin |
| 4,983,251 | A | 1/1991 | Haisma et al. |
| 4,984,865 | A | 1/1991 | Lee et al. |
| 4,999,955 | A | 3/1991 | Saito et al. |
| 5,007,209 | A | 4/1991 | Saito et al. |
| 5,082,378 | A | 1/1992 | Muller et al. |
| 5,106,394 | A | 4/1992 | Bramson |
| 5,107,627 | A | 4/1992 | Mock, Jr. et al. |
| 5,117,473 | A | 5/1992 | Pan |
| 5,136,818 | A | 8/1992 | Bramson |
| 5,155,791 | A | 10/1992 | Hsiung |
| 5,184,433 | A | 2/1993 | Maack |
| 5,185,966 | A | 2/1993 | Mock, Jr. et al. |
| 5,216,843 | A | 6/1993 | Breivogel et al. |
| 5,257,478 | A | 11/1993 | Hyde et al. |
| 5,265,381 | A | 11/1993 | Takahashi |
| 5,321,917 | A | 6/1994 | Franklin et al. |
| 5,394,254 | A | 2/1995 | Cheng |
| 5,447,464 | A | 9/1995 | Franklin et al. |
| 5,458,531 | A | 10/1995 | Matsuoka et al. |
| 5,463,709 | A | 10/1995 | Terao et al. |
| 5,464,361 | A | 11/1995 | Suzuki et al. |
| 5,465,314 | A | 11/1995 | Jie et al. |
| 5,479,549 | A | 12/1995 | Kurata |
| 5,480,344 | A | 1/1996 | Xu et al. |
| 5,481,632 | A | 1/1996 | Hirai et al. |
| 5,482,525 | A | 1/1996 | Kajioka et al. |
| 5,486,725 | A | 1/1996 | Keizer et al. |
| 5,503,590 | A | 4/1996 | Saitoh et al. |
| 5,516,328 | A | 5/1996 | Kawada |
| 5,526,452 | A | 6/1996 | Dannoux et al. |
| 5,547,417 | A | 8/1996 | Breivogel et al. |
| 5,556,323 | A | 9/1996 | Luther et al. |
| 5,566,262 | A | 10/1996 | Yamane et al. |
| 5,577,149 | A | 11/1996 | Averbeck et al. |
| 5,582,534 | A | 12/1996 | Shendon et al. |
| 5,601,474 | A | 2/1997 | Takahashi |
| 5,611,943 | A | 3/1997 | Cadien et al. |
| 5,623,567 | A | 4/1997 | Barberio et al. |
| 5,643,053 | A | 7/1997 | Shendon |
| 5,650,039 | A | 7/1997 | Talieh |
| 5,657,404 | A | 8/1997 | Buchanan et al. |
| 5,667,426 | A | 9/1997 | Minami et al. |
| 5,668,902 | A | 9/1997 | Kurata |
| 5,678,751 | A | 10/1997 | Buchanan et al. |
| 5,683,290 | A | 11/1997 | Kanda et al. |
| 5,719,978 | A | 2/1998 | Kakii et al. |
| 5,743,785 | A | 4/1998 | Lundberg et al. |
| 5,743,787 | A | 4/1998 | Ishiyama et al. |
| 5,764,833 | A | 6/1998 | Kakii et al. |
| 5,785,784 | A * | 7/1998 | Chesley et al. ..... 156/66 |
| 5,810,964 | A | 9/1998 | Shiraishi et al. |
| 5,823,859 | A | 10/1998 | Erdogan et al. |
| 5,833,520 | A | 11/1998 | Kanda et al. |
| 5,836,941 | A | 11/1998 | Yoshihara et al. |
| 5,838,448 | A | 11/1998 | Aiyer et al. |
| 5,855,503 | A | 1/1999 | Csipkes et al. |
| 5,863,449 | A | 1/1999 | Grabbe |

(Continued)

FOREIGN PATENT DOCUMENTS

JP 62-173159 A 7/1987

(Continued)

*Primary Examiner*—Lee D. Wilson
(74) *Attorney, Agent, or Firm*—Thomas Omholt; John Gase

(57) ABSTRACT

A chemical-mechanical polishing pad, and method of polishing a substrate using a polishing pad, comprising (a) a resilient subpad, and (b) a polymeric polishing film substantially coextensive with the resilient subpad, wherein the polymeric polishing film comprises (i) a polishing surface that is substantially free of bound abrasive particles, and (ii) a back surface releasably associated with the resilient subpad.

14 Claims, No Drawings

U.S. PATENT DOCUMENTS 5,876,269 A 3/1999 Torii
5,909,530 A 6/1999 Ohkubo et al.
5,919,607 A 7/1999 Lawandy
5,938,504 A 8/1999 Talieh
5,958,794 A * 9/1999 Bruxvoort et al. ..... 438/692
5,966,485 A 10/1999 Luther et al.
5,966,490 A 10/1999 Minns et al.
5,989,111 A * 11/1999 Lamphere et al. ..... 451/526
6,010,538 A 1/2000 Sun et al.
6,022,309 A 2/2000 Celliers et al.
6,038,359 A 3/2000 Moslehi et al.
6,059,638 A 5/2000 Crevasse et al.
6,083,083 A 7/2000 Nishimura
6,106,368 A 8/2000 Childers et al.
6,113,469 A 9/2000 Yoshikawa et al.
6,137,938 A 10/2000 Korn et al.
6,179,690 B1 1/2001 Talieh
6,187,515 B1 2/2001 Tran et al.
6,206,759 B1 3/2001 Agarwal et al.
6,244,935 B1 6/2001 Birang et al.
6,261,958 B1 7/2001 Crevasse et al.
6,278,816 B1 8/2001 Keur et al.
6,280,099 B1 8/2001 Wu
6,297,159 B1 10/2001 Paton
6,298,192 B1 10/2001 Yoo et al.
6,300,151 B1 10/2001 Yoon et al.
6,302,763 B1 10/2001 Buzzetti
6,302,767 B1 10/2001 Tietz
6,304,688 B1 10/2001 Korn et al.
6,309,278 B1 10/2001 Suzuki et al.
6,354,915 B1 3/2002 James et al.
6,362,107 B1 3/2002 Shiro et al.
6,488,575 B2 12/2002 Agarwal et al.
6,498,101 B1 12/2002 Wang
6,503,134 B2 1/2003 Shendon
6,537,144 B1 3/2003 Tsai et al.
6,561,873 B2 5/2003 Tsai et al.
6,602,380 B1 8/2003 Doan et al.
6,612,917 B2 9/2003 Bruxvoort
6,746,311 B1 * 6/2004 Kessel ..... 451/41
6,908,366 B2 * 6/2005 Gagliardi ..... 451/41
2001/0012427 A1 8/2001 Hyzin et al.
2001/0036341 A1 11/2001 Ohtsuka et al.
2001/0046355 A1 11/2001 Schmatz
2001/0049258 A1 12/2001 Erdogan et al.
2001/0051028 A1 12/2001 Gutierrez et al.
2003/0209448 A1 11/2003 Hu et al.
2003/0220053 A1 11/2003 Manens et al.

FOREIGN PATENT DOCUMENTS

JP 03-081708 A 4/1991
WO WO 99/33615 7/1999
WO WO 01/53042 7/2001
WO WO 02/24409 A1 3/2002

* cited by examiner

CONTINUOUS CONTOUR POLISHING OF A MULTI-MATERIAL SURFACE

FIELD OF THE INVENTION

This invention pertains to polishing, in general, and more particularly to a polishing pad and a method of polishing a substrate. The invention finds particular use in polishing substrates having a non-planar surface comprising two or more different materials.

BACKGROUND OF THE INVENTION

The ability to produce extremely smooth, continuous surfaces on a work piece or substrate is essential to many technologies. For example, the successful fabrication of integrated circuits requires that an extremely high degree of planarity be obtained on a the surface of the workpiece (e.g., an integrated circuit or "chip") such that successive layers of circuitry can be built upon one another while maintaining extremely small dimensions. In other areas of technology, such as fiber optics, the ability to produce extremely smooth, defect-free, contoured surfaces on the end-faces of optical fibers is a prerequisite for the formation of high-performance fiber optic connections.

Microelectronics and fiber optics polishing can be particularly difficult because the surfaces to be polished often comprise more than one type of material. Since different materials usually polish at different rates, it can be hard to obtain a continuous, smooth surface. Fiber optic ferrules, for example, typically have a rounded distal end adapted to abut against the distal end of a corresponding ferrule. The ferrule has a central bore that receives an optical fiber so that the end of the optical fiber is aligned and exposed at the apex of the rounded distal end. Accordingly, when two ferrules are coaxially aligned and positioned such that the rounded distal ends oppose each other, the apexes of the distal ends can abut, and the optical fibers can contact each other. In order to provide a smooth continuous contour, it is desirable to polish the contoured distal end of the ferrule together with the optical fiber. However, because the fiber polishes at a different rate from the material of the ferrule, it can be difficult to obtain a smooth, continuous curve in this manner.

Chemical-mechanical polishing can be used to polish substrates comprising more than one material, such as fiber optic ferrules. In order to control the global curvature of the surface, a polishing pad of an appropriate compliance is selected, such that the pad material will conform to the desired curvature when placed in contact with the fiber optic ferrule under a specific load. However, most chemical-mechanical polishing systems using a compliant polishing pad are not self-limiting, which means that the polishing system will over-polish a substrate if the polishing system is not stopped once a globally smooth surface is achieved. For example, if the natural polishing rate of the fiber optic material is less than that of the ferrule, over-polishing with a compliant pad can result in the polishing pad conforming to the optical fiber. As a result, the fiber can protrude from the end of the ferrule producing an unwanted local topography (e.g., large spherical errors). Alternatively, if the natural polishing rate of the fiber optic material exceeds that of the ferrule, over-polishing with a compliant pad can result in the fiber recessing into the ferrule. In either case, a discontinuous contour can result.

Another consideration in polishing substrates such as fiber optic ferrules is uniformity in polishing from one substrate to the next. Prior art polishing pads typically employ adhesives to join together polishing pad layers. Most adhesive-bonded pads are not separable, and the individual components of the pad, such as the polishing surface, cannot be independently replaced. As it is not economically practical to replace the entire pad after each polishing operation, the pad is typically used to polish several substrates or sets of substrates before it is replaced. However, the polishing surface of the pad changes slightly during each use as it abrades the substrate during polishing. As a result, the same polishing surface is not being used in each polishing operation, which can introduce some degree of non-uniformity in the polished surfaces. Furthermore, when layers of adhesive-bonded pads are replaced, the surface underlying the polishing surface can be damaged as a result of the adhesive tearing the underlying surface, or leaving a residue that causes the surface to be not entirely smooth. Such changes in the surface underlying the polishing surface of the polishing pad also can lead to non-uniformity in the polishing process.

Thus, there remains a need for effective polishing pads that can be used to produce extremely smooth contoured and/or planar surfaces. The invention provides such a polishing pad, as well as a method for its use. These and other advantages of the present invention, as well as additional inventive features, will be apparent from the description of the invention provided herein.

BRIEF SUMMARY OF THE INVENTION

The invention provides a chemical-mechanical polishing pad comprising (a) a resilient subpad, and (b) a polymeric polishing film substantially coextensive with the resilient subpad, wherein the polymeric polishing film comprises (i) a polishing surface that is substantially free of bound abrasive particles, and (ii) a back surface releasably associated with the resilient subpad. A method of polishing a substrate also is provided herein, the method comprising (a) providing a polishing pad comprising a resilient subpad and a first polymeric polishing film that is substantially coextensive with the resilient subpad, wherein the first polymeric polishing film comprises (i) a polishing surface that is substantially free of bound abrasive particles, and (ii) a back surface releasably associated with the resilient subpad, (b) contacting the polishing surface of the first polymeric polishing film with a first substrate, and (c) moving the polishing pad with respect to the first substrate so as to polish at least a portion of the first substrate.

DETAILED DESCRIPTION OF THE INVENTION

The invention provides a chemical-mechanical polishing pad comprising (a) a resilient subpad, and (b) a polymeric polishing film substantially coextensive with the resilient subpad, wherein the polymeric polishing film comprises (i) a polishing surface that is substantially free of bound abrasive particles, and (ii) a back surface releasably associated with the resilient subpad.

The term "film" as used herein with respect to the polishing film of the invention refers to material with a thickness of about 0.5 mm or less. Within the scope of the invention, the polishing film is considered to be "releasably associated" with the resilient subpad if it is associated in a manner such that the removal of the polishing film from the resilient subpad does not significantly alter any portion of the surface of the subpad that lies directly beneath a portion of the polishing surface used during polishing. The polymeric polishing film can be releasably associated with the resilient subpad with or without the use of an adhesive compound. The term "adhesive" as used herein refers to any of the commonly known class of adhesive materials such as glues, epoxies, hot-melt adhesives, pressure sensitive adhesives, and the like. For example, the back surface of the polymeric polishing film can be releasably associated with the resilient subpad by placing the polymeric polishing film on the resilient subpad, wherein there is no intervening layer (e.g., no adhesive layer) between the back surface of the polymeric polishing film and the surface of the resilient subpad. The polymeric polishing film is held in place on the resilient subpad, for example, by friction or electrostatic interaction. Alternatively, a vacuum can be applied through the resilient subpad to hold the polymeric polishing film to the surface of the resilient subpad. The vacuum can be applied through pores in the resilient subpad (e.g., using a porous subpad) or through channels formed in the resilient subpad.

Other non-adhesive methods of releasably associating the polymeric polishing film with the resilient subpad include the use of a non-adhesive liquid medium. For example, a non-adhesive liquid medium can be positioned between the back surface of the polymeric polishing film and the resilient subpad, wherein the back surface of the polymeric polishing film is releasably associated with the resilient subpad by capillary forces. The non-adhesive liquid medium can be provided, for example, by supplying a polishing composition to the polishing pad and/or substrate during polishing, wherein the polishing composition leaks between the polymeric polishing film and the resilient subpad during polishing.

Alternatively, the polishing pad can further comprise an adhesive compound positioned between the back surface of the polymeric polishing film and the resilient subpad, provided the adhesive is positioned only on one or more areas of the subpad that are disposed beneath one or more areas of the polishing surface that are not used during polishing. For example, the adhesive compound can be positioned on the center portion of the resilient subpad for applications in which the substrate contacts the polishing pad only on the areas peripheral to the center of the polishing pad during polishing. Similarly, the adhesive could be positioned on the peripheral portions of the resilient subpad for applications in which only the central portion of the polishing pad contacts the substrate during polishing. Preferred adhesives are those that facilitate easy removal of the polymeric polishing film from the resilient subpad, such as known light-tack adhesives and double-sided adhesive tapes.

Suitable polymeric polishing films for use in conjunction with the invention have a hardness such that the film substantially conforms to any global curvature present on the surface of the substrate being polished, but does not substantially conform to local defects in the global curvature (e.g., depressions or protrusions that otherwise disrupt a continuous curve). Without wishing to be bound to any particular theory, it is believed that the polymeric polishing film provides a self-limiting characteristic to the polishing pad of the invention, such that the polishing pad of the invention minimizes the impact of over-polishing. In other words, the polishing pad tends to produce a smooth contour even if polishing is continued after a smooth surface is achieved because of the reduced tendency to conform to local defects in the global curvature.

Preferred polymeric polishing films have a Shore A hardness of about 50 to 100, more preferably about 70–100, or about 90–100. Suitable polymeric polishing films include polycarbonate, polyester, polyurethane, nylon, and polyvinylchloride films, as well as films comprising a combination of such materials. The polymeric polishing films useful in conjunction with the invention are substantially or completely free of fixed or bound abrasive particles on the polishing surface. Preferably, about 75% or more of the polishing surface, more preferably about 85% or more (e.g., about 90% or more), or even about 95% or more (e.g., about 99% or more) of the polishing surface is free of fixed abrasive particles. Although the polymeric polishing film can contain fillers, such as inorganic or organic particulate fillers, within the film itself, desirably, the polymeric polishing film also is substantially unfilled (e.g., 75 wt. % or more, such as 85 wt. % or more, or even 95 wt. % or more of the polymeric polishing film is free of fillers, or the polymeric polishing film is completely free of fillers).

Although the polishing surface of the polymeric polishing film is substantially free of bound abrasive particles, the polishing surface can have a surface roughness provided by the natural surface texture of the polymeric film used or by roughening the surface of the polymeric film by known methods (e.g., by abrading, embossing, etching, etc.). The degree of surface roughness used will depend upon the desired outcome for a particular application. In general, increasing the surface roughness increases the polishing rate of the polishing surface. For most applications, the surface roughness (Ra) of the polishing surface of the polymeric polishing film is, preferably, about 0.5 μm or greater, such as about 0.7 μm or greater, or even about 1 μm or greater.

The polishing surface of the polymeric polishing film can, optionally, further comprise grooves, channels, and/or perforations which facilitate the lateral transport of polishing compositions across the surface of the polishing pad. Such grooves, channels, or perforations can be in any suitable pattern and can have any suitable depth and width. The polishing pad can have two or more different groove patterns, for example a combination of large grooves and small grooves as described in U.S. Pat. No. 5,489,233. The grooves can be in the form of slanted grooves, concentric grooves, spiral or circular grooves, or XY crosshatch pattern, and can be continuous or non-continuous in connectivity.

The polymeric polishing film can be any suitable thickness. The thickness of the polymeric polishing film used will depend upon the particular polishing application, with thicker films of a given material providing greater stiffness than thinner films. For most applications, it is preferred that the polymeric polishing film has a thickness of about 0.3 mm or less (e.g., about 0.2 mm or less), such as about 0.1 mm or less (e.g., about 0.08 mm or less), or even about 0.05 mm or less (e.g., about 0.03 mm or less). Desirably, the polymeric polishing film has a thickness that is about 50% or less (e.g., about 30% or less), such as about 20% or less, or even about 10% or less) of the combined thickness of the polymeric polishing film and the subpad.

Any suitable subpad can be used in conjunction with the invention, provided that the subpad is sufficiently resilient to allow the polymeric polishing film to deflect against the subpad when a substrate is pressed against the polishing pad, thereby conforming to any global curvature present on the surface of the substrate being polished. The choice of any particular subpad will depend in part upon the specific application in which it is used. For instance, polishing a substrate with a greater curvature may require the use of a subpad with a lower hardness rating than might be suitable for polishing a more planar substrate. Typically, the resilient subpad has a Shore A hardness that is about 10–100% of the Shore A hardness of the polymeric polishing film, such as about 50–90% of the Shore A hardness of the polymeric polishing film, preferably about 60–80% of the Shore A hardness of the polymeric polishing film. Preferred subpads have a Shore A hardness of about 100 or less, more preferably about 90 or less, or even about 80 or less (e.g., about 70 or less). Suitable subpad materials include polyurethanes, polyolefins, polycarbonates, polyvinylalcohols, nylons, rubbers, polyethylenes, polytetrafluoroethylene, polyethyleneterephthalate, polyimides, polyaramides, polyarylenes, polyacrylates, polystyrenes, polymethacrylates, polymethylmethacrylates, copolymers thereof, and mixtures thereof.

The resilient subpad can have any suitable thickness. Typically, the resilient subpad has a thickness of about 0.1 mm or more, such as about 0.5 mm or more, or even about 0.8 mm or more (e.g., about 1 mm or more). Thicker resilient subpads can also be used, such as subpads having a thickness of about 2 mm or more, such as about 4 mm or more, or even 6 mm or more (e.g., about 8 mm or more).

The polishing pad of the invention can be configured for use in conjunction with end-point detection techniques by providing a pathway in the pad through which electromagnetic radiation (e.g., visible or infrared light) can travel. For example, a portion of the subpad can be removed to provide an aperture in the subpad for the passage of light to the polymeric polishing film, or a portion of the subpad can be replaced with a material that is transparent or translucent to light to provide a window in the subpad. Alternatively, the entire subpad can be made from a material that is translucent or transparent to light. Similarly, the polymeric polishing film can be made from a material that is translucent or transparent to light in one or more areas corresponding to the window or aperture in the subpad, or the entire polymeric polishing film can be made from a material that is translucent or transparent to light. Techniques for inspecting and monitoring the polishing process by analyzing light or other radiation reflected from a surface of the workpiece are known in the art. Such methods are described, for example, in U.S. Pat. No. 5,196,353, U.S. Pat. No. 5,433,651, U.S. Pat. No. 5,609,511, U.S. Pat. No. 5,643,046, U.S. Pat. No. 5,658,183, U.S. Pat. No. 5,730,642, U.S. Pat. No. 5,838,447, U.S. Pat. No. 5,872,633, U.S. Pat. No. 5,893,796, U.S. Pat. No. 5,949,927, and U.S. Pat. No. 5,964,643. Desirably, the inspection or monitoring of the progress of the polishing process with respect to a workpiece being polished enables the determination of the polishing end-point, i.e., the determination of when to terminate the polishing process with respect to a particular workpiece.

Although the polishing pad of the invention has been described herein with respect to the polymeric polishing film and the resilient subpad, the polishing pad of the invention can be used in conjunction with additional layers (e.g., additional subpads, backing layers, etc.) without departing from the scope of the invention. Furthermore, the polishing pad of the invention can have any suitable dimensions. The polishing pad desirably is a disc shape (as is used in rotary polishing tools), but can be produced as a looped linear belt (as is used in linear polishing tools) or have a rectangular shape (as is used in oscillating polishing tools).

The invention also provides a method of polishing a substrate using the polishing pad of the invention. The method of the invention comprises (a) providing a polishing pad comprising a resilient subpad and a first polymeric polishing film that is substantially coextensive with the resilient subpad, wherein the first polymeric polishing film comprises (i) a polishing surface that is substantially free of bound abrasive particles, and (ii) a back surface releasably associated with the resilient subpad, (b) contacting the polishing surface of the first polymeric polishing film with a first substrate, and (c) moving the polishing pad with respect to the first substrate so as to polish at least a portion of the first substrate. The polymeric polishing film, resilient subpad, and all other aspects of the polishing pad are as described above with respect to the polishing pad of the invention.

Moving the polishing pad with respect to the substrate is accomplished by any suitable method, for example, by rotating, vibrating, and/or oscillating the polishing pad. Preferably, the surface of the first substrate is pressed substantially orthogonally to the polishing surface of the first polymeric polishing film. Upon contacting the polishing surface of the first polymeric polishing film with the first substrate, the polymeric polishing film deflects against the resilient subpad so as to conform to any desired global curvature in the surface of the substrate. Thus, for example, the method of the invention can be used to remove local defects while preserving any desired global curvature already present in the surface of the substrate to provide a smooth, continuous contour. Also, the method of the invention can be used to produce a desired global curvature that is different from the global curvature present in the surface of the substrate. The degree of curvature produced by the method of the invention will be affected by resilience of the subpad, the hardness of the polymeric polishing film, and the size and geometry of the substrate surface being polished, as well as other polishing parameters such as the load applied during polishing, any polishing slurry used, and the polishing rate of the material under the polishing conditions. Of, course the method of the invention also is useful for polishing flat surfaces.

The polishing method and polishing pad of the invention can be used to polish any substrate. For example, the polishing method and polishing pad can be used to polish workpieces including memory storage devices, semiconductor substrates, and glass substrates. Suitable workpieces for polishing with the polishing pad include memory or rigid disks, magnetic heads, MEMS devices, semiconductor wafers, field emission displays, and other microelectronic substrates, especially microelectronic substrates comprising insulating layers (e.g., silicon dioxide, silicon nitride, or low dielectric materials) and/or metal-containing layers (e.g., copper, tantalum, tungsten, aluminum, nickel, titanium, platinum, ruthenium, rhodium, iridium or other noble metals). The polishing method and polishing pad of the invention is particularly effective for polishing substrates wherein two or more materials are exposed on the surface of the substrate. The polishing method and polishing pad of the invention can be used to produce planar (e.g., flat) or non-planar (e.g., curved or contoured) surfaces on the substrate.

The polishing method and polishing pad are preferably used to polish optical fibers (e.g., the end-faces of optical fibers), particularly in combination with a fiber optic ferrule. As previously mentioned, it is desirable to be able to produce fiber optic ferrules that have a smooth, continuous contour across the distal end-face of the ferrule. The distal end-face of the ferrule typically comprises the surface of the ferrule and the end-face of the optical fiber within the ferrule. One criteria for evaluating the continuity of this contoured end-face is known as the spherical fiber height, which is a measurement of the amount of optical fiber that is either protruding above (positive value) or recessed below (negative value) the spherical contour of the end-face of the ferrule. A perfectly smooth contour in which the optical fiber is not protruding or recessed has a spherical fiber height of zero. Desirably, the polishing method and polishing pad of the invention can be used to polish fiber optic ferrules to an average spherical fiber height of about −50 nm to +50 nm (e.g., about −40 nm to +40 nm), preferably about −30 nm to +30 nm (e.g., about −20 nm to +20 nm), or even about −15 nm to +15 nm (e.g., about −10 nm to +10 nm).

The invention provides a method by which the polishing surface of a polishing pad can be easily and economically replaced after use. In this regard, the method of the invention further comprises (d) breaking contact between the polishing surface of the first polymeric polishing film and the first substrate, (e) removing the first polymeric polishing film from the resilient subpad, and (f) associating a second polymeric polishing film with the resilient subpad to form a second polishing pad. The composition or roughness of the second polymeric polishing film can be the same as that of the first polymeric polishing film (e.g., for repeating the same polishing process), or it can be different (e.g., for performing a second polishing process, such as a finishing polish).

After replacing the polymeric polishing film, the method of the invention may be used to continue to polish the same substrate (e.g., finish-polishing the substrate) or a different substrate of the same or different type (e.g., performing the same polishing process on several different substrates sequentially). When used to continue polishing the same substrate, the method of the invention can further comprise the steps of (g) contacting the second polymeric polishing film with the first substrate, and (h) moving the second polishing pad with respect to the first substrate so as to continue polishing at least a portion of the first substrate. Alternatively, when applied to a new substrate that is the same or different than the first substrate, the method of the invention can further comprise the steps of (g) contacting the second polymeric polishing film with a second substrate, and (h) moving the second polishing pad with respect to the second substrate so as to polish at least a portion of the second substrate.

The method of the invention also can be used in conjunction with a polishing composition (e.g., a chemical-mechanical polishing composition), wherein the method further comprises supplying a polishing composition to the substrate and/or the polishing surface of the polymeric polishing film. The particular polishing composition used will depend upon the exact nature of the substrate being polished. The polishing composition typically comprises a liquid carrier, abrasive particles, and at least one additive selected from the group consisting of oxidizers, complexing agents, corrosion inhibitors, surfactants, film-forming agents, and combinations thereof.

The following examples further illustrate the invention but, of course, should not be construed as in any way limiting its scope.

EXAMPLES

All polishing processes were performed using a Model SFP-550 polishing machine manufactured by the Seikoh-Giken Corporation (Japan). The polyurethane pad material used in the examples was FDA-grade Poly70 polyurethane manufactured by the Polyurethane Products Corporation (Addison, Ill.). Polishing times reported in the examples were operator-determined, and were not based on the natural end-point of the polishing processes.

Example 1

This example demonstrates polishing a substrate using a polishing pad without a polymeric polishing film, not according to the invention.

For each polishing run, twelve (12) single mode fiber-optic ferrules were polished directly on a 9.5 mm (0.375 inch) thick resilient polyurethane subpad, without a polymeric polishing film. The ferrules were polished for 120 seconds using a polishing pressure of about 830 kPa (120 psi). Polishing composition A (Table 5) was used.

After each polishing run, the end-face condition of the optical fibers was visually assessed by and scored as poor, fair, good, or very good. A rating of good indicates that the majority of the polished surfaces were flawless upon visual inspection, while a rating of very good indicates that all of the polished surfaces were flawless. A rating of fair indicates that at least one or more of the polished surfaces had some significant contamination or defect, while a rating of poor indicates that a majority of the polished surfaces had some contamination or defect. These results are presented in Table 1.

The average spherical fiber height of the fiber optic ferrules also was measured and is reported in Table 1. Consistency in the polishing process was calculated from the average spherical fiber height measurements, and is reported in Table 1 as ferrule-to-ferrule standard deviation.

TABLE 1

| Run No. | Fiber Endface Condition | Average Spherical Fiber Height (SFH) (nm) | Standard Deviation |
|---|---|---|---|
| 1A | Good | 54 | 19 |
| 1B | Good | 129 | 33 |
| 1C | Good | 184 | 25 |
| 1D | Good | 190 | 35 |
| 1E | Fair | 197 | 28 |
| 1F | Fair | 190 | 4 |
| 1G | Good | 145 | 17 |
| 1H | Fair | 186 | 35 |

The results of Example 1 show significant over-polishing as evidenced by large average spherical fiber height measurements in all runs. Also, the calculated ferrule-to-ferrule standard deviation values indicate a significant variation in polishing uniformity in most runs.

Example 2

This example demonstrates polishing a substrate using a polishing pad with a polymeric polishing film, according to the invention.

The end-face portions of single mode fiber optic ferrules were polished with a polishing pad comprising a 0.08 mm thick Mylar® polyester polishing film (manufactured by DuPont) and a 9.5 mm (0.375 inch) thick resilient polyurethane subpad. Twelve (12) ferrules were polished in each run. The polyester polishing film was adhered to the subpad by way of a single piece of adhesive tape positioned in the center portion of the disc-shaped pad. The polyester film was roughened using 100 grit diamond abrasive. Polishing composition B (Table 5) was used for runs 2A–2F, and polishing composition C (Table 5) was used for runs 2G–2L. Polishing pressure and polishing time varied, as indicated in Table 2.

The end-face condition, average spherical fiber height, and ferrule-to-ferrule standard deviation of each run were measured, as described with respect to Example 1. In addition, the overall removal rate was calculated for some polishing runs. The results are presented in Table 2.

TABLE 2

| Run No. | Polishing Composition | Polishing Pressure (kPa) | Polishing Time (sec) | Fiber Endface Condition | Average Spherical Fiber Height (nm) | Standard Deviation | Removal Rate (nm/min) |
|---|---|---|---|---|---|---|---|
| 2A | B | 830 | 120 | Very Good | −30 | 3.1 | ** |
| 2B | B | 830 | 120 | Very Good | −32 | 5.3 | ** |
| 2C | B | 830 | 480 | Very Good | −37 | 5.4 | ** |
| 2D | B | 830 | 1200 | Very Good | −35 | 3.4 | ** |
| 2E | B | 830 | 1200 | Very Good | −24 | 3.9 | ** |
| 2F | B | 830 | 1200 | Very Good | −20 | 3.7 | ** |
| 2G | C | 830 | 180 | Fair | −8.6 | 13.4 | ** |
| 2H | C | 830 | 420 | Fair | −29.4 | 11.8 | 278 |
| 2I | C | 510 | 180 | Fair | 23.6 | 35.8 | ** |
| 2J | C | 510 | 180 | Fair | −4.5 | 22.6 | ** |
| 2K | C | 830 | 180 | Fair | 45.7 | 26.6 | ** |
| 2L | C | 830 | 180 | Fair | 63.3 | 92.6 | ** |

** No data available for these parameters.

The results show that very good quality polishing is possible with the present invention. It is believed that the variability in the average spherical fiber height in runs 2G–2L, and the "Fair" condition of the polished surfaces of these runs, is the result of debris from the roughened polymeric film becoming attached to the ends of the optical fibers. It is believed that, under the conditions used in this example, polishing composition C used in runs 2G–2L did not remove the debris from the ends of the optical fibers as efficiently as polishing composition B used in runs 2A–2F.

As compared to Example 1, the average spherical fiber height measurements indicate significantly less over-polishing in almost all runs. Also, lower calculated ferrule-to-ferrule standard deviation values indicate that the polishing process of the invention provided greater uniformity as compared to Example 1. For runs 2D–2F, the polishing time was 1200 seconds, which is ten-times longer than the polishing time used in Example 1. Even after extended polishing, the endface condition of the fibers was very good, and the average spherical fiber height was low. These runs illustrate that the invention can be used to provide excellent polishing results under extreme conditions with little or no over-polishing.

Example 3

This example demonstrates polishing a substrate using a polishing pad with a polymeric polishing film, according to the invention.

The end-face portions of single mode fiber optic ferrules were polished with a polishing pad comprising a 0.1 mm (5 mil) thick Makrofol™ PCVM polycarbonate polishing film (manufactured by Bayer Corporation) and a 9.5 mm (0.375") thick resilient polyurethane subpad. The matte surface of the polycarbonate film provided the polishing surface without additional roughening. The polycarbonate polishing film was adhered to the subpad by way of a single piece of adhesive tape positioned in the center portion of the disc-shaped pad. Polishing was carried out using a polishing pressure of about 1900 kPa (275 psi); polishing time varied as indicated in Table 3. Polishing composition C (Table 5) was used for runs 3A–3D, and polishing composition D (Table 5) was used for runs 3E and 3F.

TABLE 3

| Run No. | Polishing Composition | Polishing Time (sec) | Fiber Endface Condition | Average Spherical Fiber Height (nm) | Standard Deviation | Removal Rate (nm/min) |
|---|---|---|---|---|---|---|
| 3A | C | 180 | Very Good | −29 | 3.7 | ** |
| 3B | C | 180 | Very Good | −26 | 1.7 | ** |
| 3C | C | 600 | Very Good | −16 | 1.2 | 528 |
| 3D | C | 180 | Very Good | −15 | 3.1 | ** |
| 3E | D | 180 | Very Good | −33 | 2.0 | ** |
| 3F | D | 180 | Very Good | −25 | 3.4 | ** |

** No data available for these parameters.

The end-face condition, average spherical fiber height, and ferrule-to-ferrule standard deviation of each run were measured, as described with respect to Example 1. In addition, the overall removal rate was calculated for polishing run 3C. The results are presented in Table 3.

As with Example 2, the results of Example 3 indicate significantly less over-polishing and greater ferrule-to-ferrule uniformity as compared to Example 1.

Example 4

This example demonstrates polishing a substrate using a polishing pad with a polymeric polishing film, according to the invention.

The end-face portions of single mode fiber optic ferrules were polished with a polishing pad comprising a 0. 1 mm (5 mil) thick Makrofol™ DE 1–4D polycarbonate film (manufactured by Bayer Corporation) and a 9.5 mm (0.375 inch) thick resilient polyurethane subpad. The matte surface of the polycarbonate film provided the polishing surface without additional roughening. The polycarbonate polishing film was adhered to the subpad by way of a single piece of adhesive tape positioned in the center portion of the disc-shaped pad. Polishing pressure and polishing time varied, as indicated in Table 4. Each polishing run was performed with one of polishing slurries D–H (Table 5), as also indicated in Table 4.

The end-face condition, average spherical fiber height, and ferrule-to-ferrule standard deviation of each run were measured, as described with respect to Example 1. In addition, the overall removal rate was calculated for some polishing runs. The results are presented in Table 4.

As with Examples 2 and 3, the results of Example 4 indicate low incidence of over-polishing as evidenced by the low average spherical fiber height measurements overall, and high ferrule-to-ferrule uniformity. The results show that high-quality polishing can be obtained using a variety of polishing parameters in conjunction with the present invention.

TABLE 4

| Run No. | Polishing Slurry | Polishing Pressure (kPa) | Polishing Time (sec) | Fiber Endface Condition | Average Spherical Fiber Height (nm) | Standard Deviation | Removal Rate (nm/min) |
|---|---|---|---|---|---|---|---|
| 4A | D | 1900 | 180 | Very Good | −17 | 2.3 | ** |
| 4B | D | 1900 | 600 | Very Good | −14 | 0.6 | 556 |
| 4C | D | 1900 | 180 | Very Good | −15 | 4.4 | ** |
| 4D | D | 1900 | 180 | Good | −15 | 1.9 | ** |
| 4E | E | 1900 | 180 | Very Good | −18.8 | ** | ** |
| 4F | E | 1900 | 600 | Very Good | ** | ** | 473 |
| 4G | E | 830 | 180 | Very Good | 10.8 | ** | ** |
| 4H | E | 830 | 600 | Very Good | ** | ** | 195 |
| 4I | F | 830 | 180 | Very Good | 22.8 | ** | ** |
| 4J | F | 830 | 600 | Very Good | ** | ** | 222 |
| 4K | G | 1900 | 180 | Very Good | 23.3 | 5.89 | ** |
| 4L | G | 1900 | 600 | Very Good | ** | ** | 528 |
| 4M | H | 1900 | 180 | Very Good | 19.6 | 4.08 | ** |
| 4N | H | 1900 | 600 | Very Good | ** | ** | 723 |

** No data available for these parameters.

Polishing Compositions in Examples

The polishing compositions used in Examples 1–4 are recited in Table 5.

TABLE 5

| Slurry | Silica (wt. %) | Silica Type[1] | Alumina[2] (wt. %) | PVP (wt. %) | pH |
|---|---|---|---|---|---|
| A | 8 | precipitated | 0.75 | 0.2 | 4 |
| B | 12 | precipitated | 1 | 0.2 | 5.4 |
| C | 8 | precipitated | 1 | 0.2 | 5.4 |
| D | 8 | precipitated | 2 | 0.2 | 5.4 |
| E | 10 | precipitated | 0 | 0.2 | 5.5 |
| F | 10 | fumed | 0 | 0.2 | 4.8 |
| G | 12.5 | fumed | 0 | 0.2 | 5.9 |
| H | 12.5 | fumed | 0 | 0.1 | 7.8 |

[1]The precipitated silica was Bindzil ® 40/130 (manufactured by Akzo Nobel). The fumed silica was CAB-O-SIL ® LM-150 fumed silica (manufactured by Cabot Corporation) having an average aggregate particle size of about 150 nm.
[2]The alumina used was fumed alumina (manufactured by Cabot Corporation) having an average aggregate particle size of about 120 nm.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A chemical-mechanical polishing pad comprising:

(a) a resilient subpad, and (b) a polymeric polishing film substantially coextensive with the resilient subpad, wherein the polymeric polishing film comprises (i) a polishing surface that is substantially free of bound abrasive particles, and (ii) a back surface releasably associated with the resilient subpad by electrostatic interaction and without the use of an adhesive compound.

2. The polishing pad of claim 1, wherein the polymeric polishing film has a Shore A hardness of about 50 to 100.

3. The polishing pad of claim 1, wherein the polymeric polishing film is substantially unfilled.

4. The polishing pad of claim 1, wherein the polishing pad further comprises an adhesive compound positioned between the back surface of the polymeric polishing film and the resilient subpad only on one or more areas of the subpad that are disposed beneath one or more areas of the polishing surface that are not used during polishing.

5. The polishing pad of claim 1, wherein the polymeric polishing film comprises a material selected from the group consisting of polycarbonate, polyester, nylon, polyvinyl chloride, and combinations thereof.

6. The polishing pad of claim 1, wherein the surface roughness (Ra) of the polishing surface of the polymeric polishing film is about 0.5 μm or greater.

7. The polishing pad of claim 1, wherein the polymeric polishing film has a thickness of about 0.3 mm or less.

8. The polishing pad of claim 1, wherein the resilient subpad has a thickness of about 0.1 mm or more.

9. The polishing pad of claim 1, wherein the polymeric polishing film has a thickness that is about 50% or less of the combined thickness of the polymeric polishing film and the subpad.

10. The polishing pact of claim 1, wherein the resilient subpad has a Shore A hardness of about 100 or less.

11. The polishing pad of claim 1, wherein the resilient subpad has a Shore A hardness that is about 10–100% of the Shore A hardness of the polymeric polishing film.

12. The polishing pad of claim 1, wherein the resilient subpad comprises polyurethane.

13. A chemical-mechanical polishing pad comprising:

(a) a resilient subpad, and (b) a polymeric polishing film substantially coextensive with the resilient subpad, wherein the polymeric polishing film comprises (i) a polishing surface that is substantially free of bound abrasive particles, and (ii) a back surface releasably associated with the resilient subpad, further comprising a non-adhesive liquid medium positioned between the back surface of the polymeric polishing film and the resilient subpad, wherein the back surface of the polymeric polishing film is releasably associated with the resilient subpad by capillary forces.

14. The polishing pad of claim 13, wherein the non-adhesive liquid medium is a polishing composition.

* * * * *